US005457783A

United States Patent [19]

Chhatwal

[11] Patent Number: 5,457,783

[45] Date of Patent: Oct. 10, 1995

[54] ADAPTIVE SPEECH CODER HAVING CODE EXCITED LINEAR PREDICTION

[75] Inventor: Harprit S. Chhatwal, Heston, United Kingdom

[73] Assignee: Pacific Communication Sciences, Inc., San Diego, Calif.

[21] Appl. No.: 927,137

[22] Filed: Aug. 7, 1992

[51] Int. Cl.[6] ..... G10L 9/02

[52] U.S. Cl. ..... 395/2.28; 381/35

[58] Field of Search ..... 381/41, 38, 35; 395/2.28

[56] References Cited

U.S. PATENT DOCUMENTS

| | | | |
|---|---|---|---|
| 4,817,157 | 3/1989 | Gerson | 381/40 |
| 5,012,517 | 4/1991 | Wilson et al. | 381/31 |
| 5,042,069 | 8/1991 | Chhatwal et al. | 381/31 |
| 5,060,269 | 10/1991 | Zinser | 381/38 |
| 5,105,464 | 4/1992 | Zinser | 381/38 |
| 5,119,423 | 6/1992 | Shiraki et al. | 381/31 |
| 5,138,661 | 8/1992 | Zinser | 381/35 |
| 5,138,662 | 8/1992 | Amano et al. | 381/36 |
| 5,187,745 | 2/1993 | Yip et al. | 381/36 |
| 5,195,168 | 3/1993 | Yong | 395/2 |
| 5,224,167 | 6/1993 | Toniguchi et al. | 381/36 |

OTHER PUBLICATIONS

Bergström et al, "High Temporal Resolutin in Multi–Pulse Coding", 1989 Int'l Conf on Acoustics, Speech, & Signal Processing, May 23–26, 1989, pp. 770–773 vol. 2.

*Primary Examiner*—Allen R. MacDonald

*Assistant Examiner*—Thomas Onka

*Attorney, Agent, or Firm*—Woodcock Washburn Kurtz Mackiewicz & Norris

[57] ABSTRACT

Methods and apparatus for speech coding are disclosed for converting analog speech signals to digital speech signals for transmission. The speech coder, utilizing CELP techniques, includes a first filter for filtering out the spectral information from the speech signal. The spectral information is provided for transmission. A second filter is provided for filtering out the pitch information from the speech signal and such pitch information is also provided for transmission. A codevector generator determines, in one embodiment, the characteristics of a bi-pulse codevector representative of the speech signal. In this embodiment the impulse response of the first filter is truncated for determining the codevector characteristics. In this embodiment it is also preferred to determine the codevector characteristics by conducting a numerator only search in relation to a traditional fraction used for determining codevectors. In another embodiment, the codevector generator includes a transformer for transforming codevector possibilities from being representative of pulse-like sound to being representative of noise-like sound. It is especially preferred for the transform to be a Hadamard transform. It is also preferred to scramble the transformed codevector to modify the sequency properties. In still another embodiment the bi-pulse codevector generator and the scrambled codevector generator are combined with a single pulse codevector generator. In such an embodiment, it is preferred to include a comparator for evaluating the characteristics determined by the three codebook generators and choosing the output of the one providing the best codebook vector.

16 Claims, 7 Drawing Sheets

ADAPTIVE SPEECH CODER HAVING CODE EXCITED LINEAR PREDICTION

FIELD OF THE INVENTION

The present invention relates to the field of speech coding, and more particularly, to improvements in the field of adaptive coding of speech or voice signals wherein code excited linear prediction (CELP) techniques are utilized.

BACKGROUND OF THE INVENTION

Digital telecommunication carrier systems have existed in the United States since approximately 1962 when the T1 system was introduced. This system utilized a 24-voice channel digital signal transmitted at an overall rate of 1.544 Mb/s. In view of cost advantages over existing analog systems, the T1 system became widely deployed. An individual voice channel in the T1 system was typically generated by band limiting a voice signal in a frequency range from about 300 to 3400 Hz, sampling the limited signal at a rate of 8 kHz, and thereafter encoding the sampled signal with an 8 bit logarithmic quantizer. The resultant digital voice signal was a 64 kb/s signal. In the T1 system, 24 individual digital voice signals were multiplexed into a single data stream.

Because the overall data transmission rate is fixed at 1.544 Mb/s, the T1 system is limited to 24 voice channels if 64 kb/s voice signals are used. In order to increase the number of voice signals or channels and still maintain a system transmission rate of approximately 1.544 Mb/s, the individual signal transmission rate must be reduced from 64 kb/s to some lower rate. The problem with lowering the transmission rate in the typical T1 voice signal generation scheme, by either reducing the sampling rate or reducing the size of the quantizer, is that certain portions of the voice signal essential for accurate reproduction of the original speech is lost. Several alternative methods have been proposed for converting an analog speech signal into a digital voice signal for transmission at lower bit rates, for example, transform coding (TC), adaptive transform coding (ATC), linear prediction coding (LPC) and code excited linear prediction (CELP) coding. For ATC it is estimated that bit rates as low as 12–16 kb/s are possible. For CELP coding it is estimated that bit rates as low as 4.8 kb/s are possible.

In virtually all speech signal coding techniques, a speech signal is divided into sequential blocks of speech samples. In TC and ATC, the samples in each block are arranged in a vector and transformed from the time domain to an alternate domain, such as the frequency domain. In LPC and CELP coding, each block of speech samples is analyzed in order to determine the linear prediction coefficients for that block and other information such as long term predictors (LTP). Linear prediction coefficients are equation components which reflect certain aspects of the spectral envelope associated with a particular block of speech signal samples. Such spectral information represents the dynamic properties of speech, namely formants.

Speech is produced by generating an excitation signal which is either periodic (voiced sounds), aperiodic (unvoiced sounds), or a mixture (e.g. voiced fricatives). The periodic component of the excitation signal is known as the pitch. During speech, the excitation signal is filtered by a vocal tract filter, determined by the position of the mouth, jaw, lips, nasal cavity, etc. This filter has resonances or formants which determine the nature of the sound being heard. The vocal tract filter provides an envelope to the excitation signal. Since this envelope contains the filter formants, it is known as the formant or spectral envelope. It is this spectral envelope which is reflected in the linear prediction coefficients.

Long Term Predictors are filters reflective of redundant pitch structure in the speech signal. Such structure is removed by estimating the LTP values for each block and subtracting those values from current signal values. The removal of such information permits the speech signal to be converted to a digital signal using fewer bits. The LTP values are transmitted separately and added back to the remaining speech signal at the receiver. In order to understand how a speech signal is reduced and converted to digital form using LPC techniques, consider the generation of a synthesized or reproduced speech signal by an LPC vocoder.

A generalized prior art LPC vocoder is shown in FIG. 1. The device shown converts transmitted digital signals into synthesized voice signals, i.e., blocks of synthesized speech samples. Basically, a synthesis filter, utilizing the LPCs determined for a given block of samples, produces a synthesized speech output by filtering the excitation signal in relation to the LPCs. Both the synthesis filter coefficients (LPCs) and the excitation signal are updated for each sample block or frame (i.e. every 20–30 milliseconds). As shown, the excitation signal can be either a periodic excitation signal or a noise excitation signal.

It will be appreciated that synthesized speech produced by an LPC vocoder can be broken down into three basic elements:

(1) The spectral information which, for instance, differentiates one vowel sound from another and is accounted for by the LPCs in the synthesis filter;

(2) For voiced sounds (e.g. vowels and sounds like z, r, l, w, v, n), the speech signal has a definite pitch period (or periodicity) and this is accounted for by the periodic excitation signal which is composed largely of pulses spaced at the pitch period (determined from the LTP);

(3) For unvoiced sounds (e.g., t, p, s, f, h), the speech signal is much more like random noise and has no periodicity and this is provided for by the noise excitation signal.

As shown in FIG. 1 a switch controls which form of excitation signal is fed to the synthesis filter. The gain controls the actual volume level of the output speech. Both types of excitation (2) and (3) are, therefore, very different in the time domain (one being made up of equally spaced pulses while the other is noise-like) but both have the common property of a flat spectrum in the frequency domain. The correct spectral shape will be provided at the output of the synthesis by the LPCs.

It is noted that use of an LPC vocoder requires the transmission of only the LPCs and the excitation information, i.e., whether the switch provides periodic or noise-like excitation to the speech synthesizer. Consequently, a reduced bit rate can be used to transmit speech signals processed in an LPC vocoder.

There are, however, several flaws in the generalized LPC vocoder approach which effect the quality of speech reproduction, i.e. the speech heard in a telephone handset. One flaw is the need to either choose between pulse-like or noise-like excitation, which decision is made every frame based on the characteristics of the input speech at that moment. For semi-voiced speech (or speech in the presence of a lot of background noise), this can lead to a lot of flip-flopping between the two types of excitation signals, seriously degrading voice quality.

CELP vocoders overcome this problem by leaving ON both the periodic and noise-like signals at the same time. The degree to which each of these signals makes up the excitation signal (e(n)) for provision to the synthesis filter is determined by separate gains which are assigned to each of the two excitations. Thus, $$e(n)=\beta \cdot p(n)+g \cdot c(n) \tag{1}$$

where p(n)=pulse-like periodic component c(n)=noise-like component

β=gain for periodic component g=gain for noise component

If g=0, the excitation signal will be totally pulse-like while if β=0, the excitation signal is totally noise-like. The excitation will be a mixture of the two if the gains are both non-zero.

One other difference is noted between CELP and simple LPC vocoders. During a coding operation in an LPC vocoder, the input speech is analyzed in a step-by-step manner to determine what the most likely value is for the pitch period of the input speech. The important point to note is that this decision about the best pitch period is final. There is no comparison made against other possible pitch periods.

In a CELP vocoder, the approach to the periodic excitation component or pitch is much more rigorous. Out of a set of possible pitch periods (which covers the range of possible pitch for all speakers be they male, female or children), every single possible value is tried in turn and speech is synthesized assuming this value. The error between the actual speech and the synthesized speech is calculated and the pitch period that gives the minimum error is chosen. This decision procedure is a closed-loop approach because an error is calculated for each choice and is fed back to the decision part of the process which chooses the optimal pitch value. By Contrast, traditional LPC vocoders use an open-loop approach where the error is not explicitly calculated and there is no decision as to which pitch period to choose from a set of possibilities.

Consider also the noise component of the excitation signal. The CELP vocoder has stored within it several hundred (or possibly several thousand) noise-like signals each of which is one frame long. The CELP vocoder uses each of these noise-like signals, in turn, to synthesize output speech and chooses the one which produces the minimum error between the input and synthesized speech signals, i.e., another closed-loop procedure. This stored set of noise-like signals is known as a codebook and the process of searching through each of the codebook signals in turn to find the best one is known as a codebook search. The major advantage of the closed-loop CELP approach is that, at the end of the search, the best possible values have been chosen for a given input speech signal—leading to major improvements in speech quality.

It is noted that use of CELP coding techniques requires the transmission of only the LPC values, LTP values and address of the chosen codebook signal. It is not necessary to transmit an excitation signal. Consequently, CELP coding techniques are particularly desirable to increase the number of voice channels in the T1 system.

The primary disadvantage with current CELP coding techniques is the amount of computing power required. In CELP coding it is necessary to search a large set of possible pitch values and codebook entries. The high complexity of the traditional CELP approach is only incurred at the transmitter since the receiver consists of just the simple synthesis structure shown in FIG. 2. The present invention overcomes the need to perform traditional codebook searching. In order to understand the significance of such an improvement, it is helpful to review the traditional CELP coding techniques.

The general CELP speech signal conversion operation is shown in FIG. 3. As shown, the order of conversion processes is as follows: (i) compute LPC coefficients, (ii) use LPC coefficients in determining LTP parameters (i.e. best pitch period and corresponding gain β), (iii) use LPC coefficients and LTP parameters in a codebook search to determine the codebook parameters (i.e. the best codeword c(n) and corresponding gain g). In the present invention, it is this final process which has been improved.

The codebook search strategy consists of taking each codebook vector (c(n)) in turn, passing it through the synthesis filter, comparing the output signal with the input speech signal and minimizing the error. Certain preprocessing steps are required. At the start of any particular frame, the excitation components associated with the LTP (p(n)) and the codebook (c(n)) are still to be computed. However even if both of these signals were to be completely zero for the whole frame, the synthesis filter nonetheless has some memory associated with it, thereby producing an output for the current frame even with no input. This frame of output due to the synthesis filter memory is known as the ringing vector r(n). In mathematical terms, this ringing vector can be represented by the following filtering operation:

$$r(n)=\sum_{i=1}^{p} \alpha_i r(n-i) \tag{2}$$

where $\{\alpha_i$ for i=1 to p$\}$ is the set of LPC coefficients. We now have the component of the output synthesized speech signal (s'(n)) which would be generated even if the excitation signal (e(n)) were zero. However, passing e(n) through the LPC synthesis filter gives a signal y(n) which can be represented as follows:

$$y(n)=e(n)+\sum_{i=1}^{p} \alpha_i y(n-i) \tag{3}$$

and thus, this e(n) based signal together with the ringing vector produce the synthesized speech signal s'(n):

$$s'(n)=r(n)+y(n) \tag{4}$$

It will be appreciated that the above equations or digital filtering expressions are somewhat cumbersome. In CELP coding it is desirable for the various processing operations to be described in matrix form. Consider first the synthesis filter. The impulse response of a filter is defined by the output obtained from an input signal having a pulse of value +1 at time zero. Now, if the LPC synthesis filter has an impulse response a(n) (where n represents the speech samples in the range 0 to (N−1) and N is the length of the frame or block), one can construct an (N-by-N) matrix representative of the impulse response of the LPC synthesis filter as follows:

$$A=\begin{bmatrix} a_0 & a_1 & a_2 & \cdot & \cdot & \cdot & a_{n-1} \\ 0 & a_0 & a_1 & \cdot & \cdot & \cdot & a_{n-2} \\ 0 & 0 & a_0 & \cdot & \cdot & \cdot & a_{n-3} \\ \cdot & \cdot & \cdot & \cdot & & & \cdot \\ \cdot & \cdot & \cdot & & \cdot & & \cdot \\ \cdot & \cdot & \cdot & & & \cdot & \cdot \\ 0 & 0 & 0 & \cdot & \cdot & \cdot & a_0 \end{bmatrix} \quad (5)$$

The codebook signal c(n) can be represented in matrix form by an (N-by-1) vector c. This vector will have exactly the same elements as c(n) except in matrix form. The operation of filtering c by the impulse response of the LPC synthesis filter A can be represented by the matrix multiple Ac. This multiple produces the same result as the signal y(n) in equation (3) for β equal to zero.

The synthesized output speech vector s' can be represented in matrix form as:

$$s'=r+Ae$$

where r and e are the (N-by-1) vector representations of the signals r(n), e(n) (the ringing signal and the excitation signal) respectively. The result is the same as equation (4) but now in matrix form. From equation (1), the synthesized speech signal can be rewritten in matrix form as:

$$\begin{aligned} s' &= r+A(\beta\cdot p+g\cdot c) \\ &= r+\beta Ap+gAc \end{aligned} \quad (6)$$

Since s' is an approximation to the actual input speech vector s (i.e. s'≅s), equation (6) can be rearranged as:

$$gAc\cong s-r-\beta Ap \quad (7)$$

A typical prior art codebook search is shown in FIG. 4 which sets forth the implementation of equations 5, 6 and 7 above. First, the input speech signal has the ringing vector r removed. Next, the LTP vector p (i.e. the pitch or periodic component p(n) of the excitation) is filtered by the LPC synthesis filter, represented by Ap, and then subtracted off the resulting signal is the so-called target vector x which is approximated by the term gAc.

During the actual codebook search, there are two important variables ($C_i$,$G_i$) which must be computed. These are given in matrix terms as:

$$C_i=c^tA^tx$$

$$G_i=c^tA^tAc \quad (8)$$

where $A^t$ is the transpose of the impulse response matrix A of the LPC synthesis filter. Solving equation (8), reveals that both $C_i$, $G_i$ are scaler values (i.e. single numbers, not vectors). These two numbers are important as they together determine which is the best codevector and also the best gain g.

As mentioned before, the codebook is populated by many hundreds of possible vectors c. Consequently, it is desirable not to form Ac or $c^tA^t$ for each possible codebook vector. This result is achieved by precomputing two variables before the codebook search, the (N-by-1) vector d and the (N-by-N) matrix F such that:

$$d=A^tx \ \& \ F=A^tA \quad (9)$$

where x is the target vector and A is impulse response matrix of the LPC synthesis filter. The process of pre-forming d is known as "backward filtering". As a result of such backward filtering, during the codebook search, only the following operations need be performed:

$$C_i=c^td$$

$$G_i=c^tFc \quad (10)$$

Traditionally, the selected codebook vector is that vector associated with the largest value for:

$$E=\frac{C_i^2}{G_i}$$

The correct gain g for a given codebook vector is given by:

$$\frac{C_i}{G_i}$$

Unfortunately, even this simplified codebook search can require either excessive amounts of time or excessive amounts of processing power.

An example of a CELP vocoder is shown in U.S. Pat. No. 4,817,157—Gerson. There is described an excitation vector generation and search technique for a speech coder using a codebook having excitation code vectors. A set of basis vectors are said to be used along with the excitation signal codewords to generate the codebook of excitation vectors. The codebook is searched using knowledge of how the codevectors are generated from the basis vector. It is claimed that a reduction in complexity of approximately 10 times results from practicing the techniques of this patent. However, the technique still requires the storage of codebook vectors. In addition, the codebook search involves the following steps for each vector: scaling the vector; filtering the vector by long term predictor components to add pitch information to the vector; filtering the vector by short term predictors to add spectral information; subtracting the scaled and double filtered vector from the original speech signal and analyzing the answer to determine whether the best codebook vector has been chosen.

Accordingly, a need still exists for a CELP coder which is capable of quickly searching, without the need for relatively significant computing power, the codebook for the proper codebook vector c.

SUMMARY OF THE INVENTION

The problems of the prior art are overcome and the advantages of the invention are achieved in an apparatus and method for speech coding in which analog speech signals are converted to digital speech signals for transmission. The speech coder, utilizing CELP techniques, includes a first filter for filtering out the spectral information from the speech signal. The spectral information is provided for transmission. A second filter is provided for filtering out the pitch information from the speech signal and such pitch information is also provided for transmission. A codevector generator determines, in one embodiment, the characteristics of a bi-pulse codevector representative of the speech signal. In this embodiment the impulse response of the first filter is truncated for determining the codevector characteristics. In this embodiment it is also preferred to determine the codevector characteristics by conducting a numerator only search in relation to a traditional fraction used for determining codevectors. In another embodiment, the codevector generator includes a transformer for transforming codevector possibilities from being representative of pulse-like sound to being representative of noise-like sound. It is especially preferred for the transform to be a Hadamard transform. It is also preferred to scramble the transformed codevector to modify the sequency properties. In still another embodiment the bi-pulse codevector generator and the scrambled codevector generator are combined with a single pulse codevector generator. In such an embodiment, it is preferred to include a comparator for evaluating the characteristics determined by the three codebook generators and choosing the output of the one providing the best codebook vector.

BRIEF DESCRIPTION OF THE DRAWINGS

These and other objects and advantages of the invention will become more apparent from the following detailed description when taken in conjunction with the following drawings, in which.

DETAILED DESCRIPTION OF THE PREFERRED EMBODIMENT

As will be more completely described with regard to the figures, the present invention is embodied in a new and novel apparatus and method for adaptive speech coding wherein rates have been significantly reduced. Generally, the present invention enhances CELP coding for reduced transmission rates by providing more efficient methods for performing a codebook search.

Figure 5:
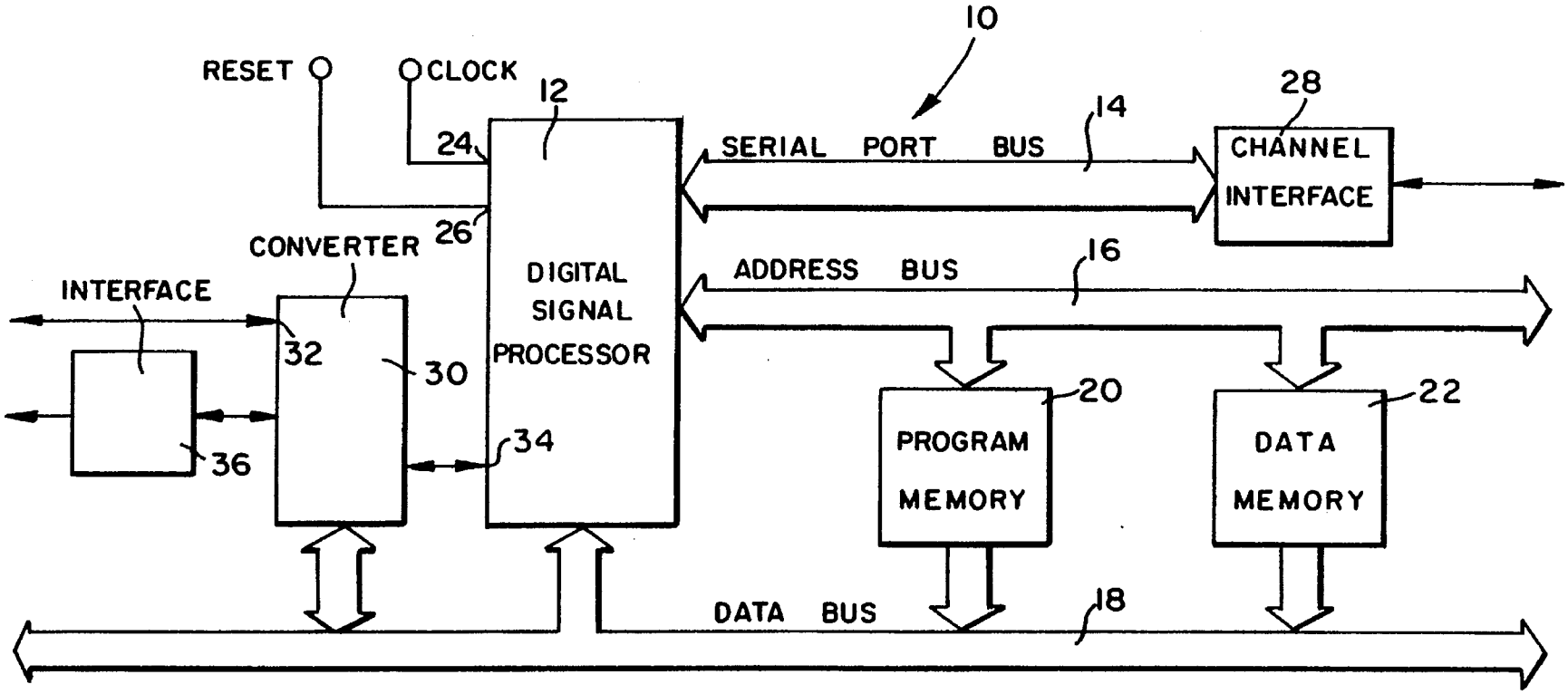
FIG. 5 is a schematic view of an adaptive speech coder in accordance with the present invention.

An adaptive CELP coder constructed in accordance with the present invention is depicted in FIG. 5 and is generally referred to as 10. The heart of coder 10 is a digital signal processor 12, which in the preferred embodiment is a TMS320C51 digital signal processor manufactured and sold by Texas Instruments, Inc. of Houston, Tex. Such a processor is capable of processing pulse code modulated signals having a word length of 16 bits.

Processor 12 is shown to be connected to three major bus networks, namely serial port bus 14, address bus 16, and data bus 18. Program memory 20 is provided for storing the programming to be utilized by processor 12 in order to perform CELP coding techniques in accordance with the present invention. Such programming is explained in greater detail in reference to FIGS. 6 through 9. Program memory 20 can be of any conventional design, provided it has sufficient speed to meet the specification requirements of processor 12. It should be noted that the processor of the preferred embodiment (TMS320C51) is equipped with an internal memory. Data memory 22 is provided for the storing of data which may be needed during the operation of processor 12.

A clock signal is provided by conventional clock signal generation circuitry (not shown) to clock input 24. In the preferred embodiment, the clock signal provided to input 24 is a 20 MHz clock signal. A reset input 26 is also provided for resetting processor 12 at appropriate times, such as when processor 12 is first activated. Any conventional circuitry may be utilized for providing a signal to input 26, as long as such signal meets the specifications called for by the chosen processor.

Processor 12 is connected to transmit and receive telecommunication signals in two ways. First, when communicating with CELP coders constructed in accordance with the present invention, processor 12 is connected to receive and transmit signals via serial port bus 14. Channel interface 28 is provided in order to interface bus 14 with the compressed voice data stream. Interface 28 can be any known interface capable of transmitting and receiving data in conjunction with a data stream operating at the prescribed transmission rate.

Second, when communicating with existing 64 kb/s channels or with analog devices, processor 12 is connected to receive and transmit signals via data bus 18. Converter 30 is provided to convert individual 64 kb/s channels appearing at input 32 from a serial format to a parallel format for application to bus 18. As will be appreciated, such conversion is accomplished utilizing known codecs and serial/parallel devices which are capable of use with the types of signals utilized by processor 12. In the preferred embodiment processor 12 receives and transmits parallel 16 bit signals on bus 18. In order to further synchronize data applied to bus 18, an interrupt signal is provided to processor 12 at input 34. When receiving analog signals, analog interface 36 serves to convert analog signals by sampling such signals at a predetermined rate for presentation to converter 30. When transmitting, interface 36 converts the sampled signal from converter 30 to a continuous signal.

Figure 6:
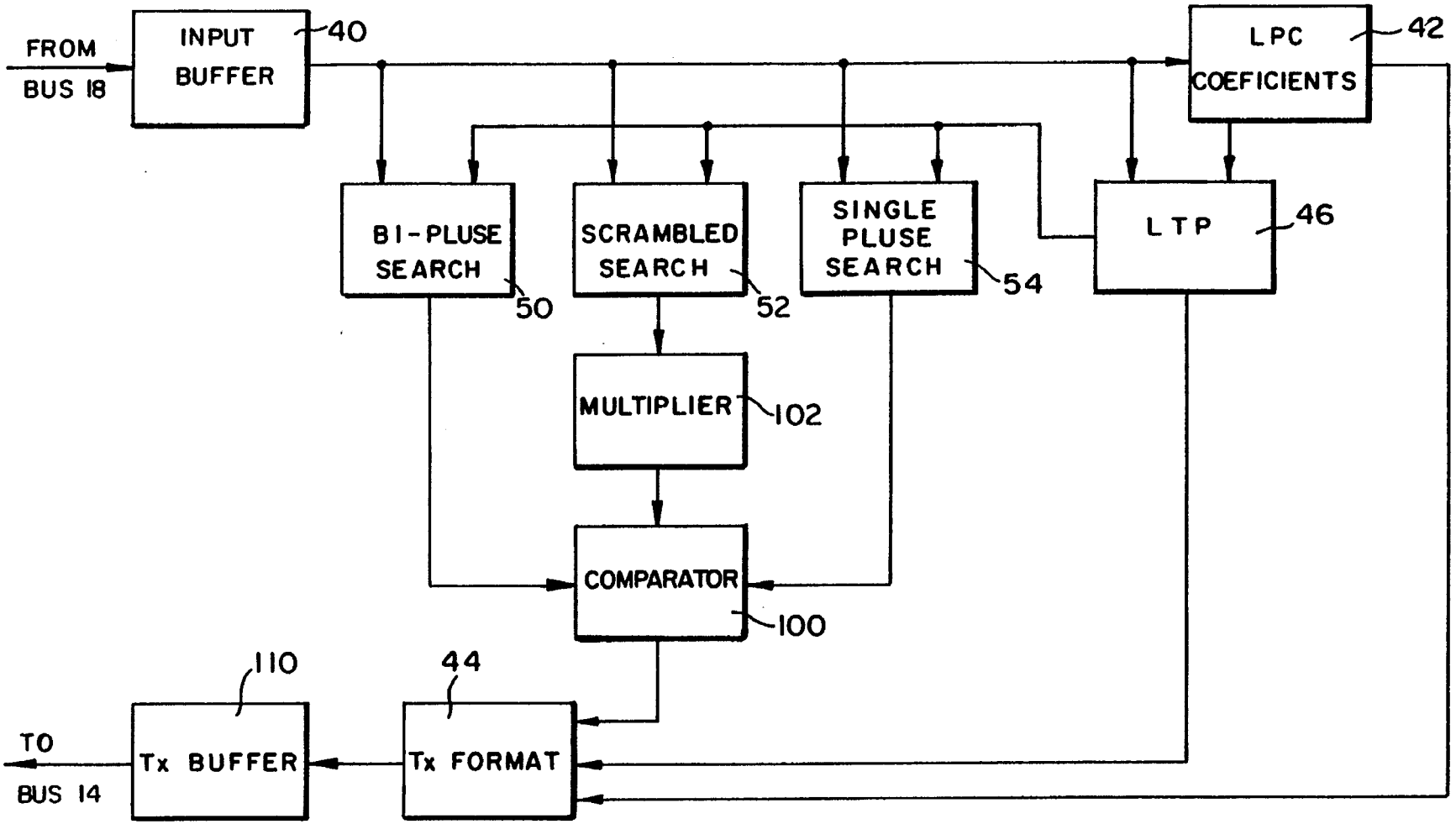
FIG. 6 is a general flow chart of those operations performed in the adaptive coder shown in FIG. 5, prior to transmission.

With reference to FIGS. 6–9, the programming will be explained which, when utilized in conjunction with those components shown in FIG. 5, provides a new and novel CELP coder. Adaptive speech coding for transmission of telecommunications signals in accordance with the CELP techniques of the present invention is shown in FIG. 6.

Telecommunication signals to be coded and transmitted appear on bus 18 and are presented to input buffer 40. Such telecommunication signals are sampled signals made up of 16 bit PCM representations of each sample where sampling occurs at a frequency of 8 kHz. For purposes of the present description, assume that a voice signal sampled at 8 kHz is to be coded for transmission. Buffer 40 accumulates a predetermined number of samples into a sample block.

LPCs are determined for each block of speech samples at 42. The technique for determining the LPCs can be any desired technique such as that described in U.S. Pat. No. 5,012,517—Wilson et al., incorporated herein by reference. It is noted that the cited U.S. Patent concerns adaptive transform coding, however, the techniques described for determining LPCs are applicable to the present invention.

The determined LPCs are formatted for transmission as side information at 44. The determined LPCs are also provided for LTP processing at 46, particularly to form the LPC synthesis filter.

LTPs are determined for each block of speech samples at 46. The periodicity or pitch based information can be determined through the use of any known technique such as that described previously. The fundamental prerequisite for deriving an LTP filter is the calculation of a precise pitch or fundamental frequency estimate. The determined LTPs are also formatted for transmission as side information.

It is also noted that in determining LTPs at 44, the ringing vector associated with the synthesis filter is removed from the speech signal and the vector p (representative of LTP pitch information) is removed from the speech signal in accordance with equation (7), thereby forming the target vector x. The so-modified speech signal is thereafter provided for codebook searching in accordance with the present invention.

As will be described herein, three forms of codebook searching are performed in the present invention, namely, bi-pulse searching at 50, scrambled searching at 52 and single pulse searching at 54. Consider first the bi-pulse searching technique shown in FIG. 7. It will be recalled that codebooks can be populated by many hundreds of possible vectors c. Since it is not desirable to form Ac or $c^tA^t$ for each possible vector, precomputing two variables occurs before the codebook search, the (N-by-1) vector d and the (N-by-N) matrix F (equation 9). The process of pre-forming d by backward filtering is performed at 60.

Since the codebook search forms such a critical part of the total computations in CELP coding, it's vital that efficient search strategies be used to compute the best codeword. However, it is just as important to have a codebook in place which allows the computation of $C_i$, $G_i$ in an efficient manner.

Two major requirements on codebook vectors c are (i) that they have a flat frequency spectrum (since they will be shaped into the correct form for each particular sound by the synthesis filter) and (ii) that each codeword is sufficiently different from each other so that entries in the codebook are not wasted by having several almost identical to each other.

In the present invention all the entries in the codebook effectively consist of an (N-by-1) vector which is zero in all of its N samples except for two entries which are +1 and −1 respectively. As indicated previously, the preferred value of N is 64, however, in order to illustrate the principles of the invention, a smaller number of samples per vector is shown.

Thus each codevector c is of the form:

$$c = \begin{bmatrix} 0 \\ 0 \\ \cdot \\ \cdot \\ \cdot \\ 0 \\ 1 \\ 0 \\ \cdot \\ \cdot \\ \cdot \\ 0 \\ -1 \\ 0 \\ \cdot \\ \cdot \\ \cdot \\ 0 \end{bmatrix} \begin{array}{l} \\ \\ \\ \\ \\ \\ \text{row } i \\ \\ \\ \\ \\ \\ \\ \text{row } j \\ \\ \\ \\ \\ \\ \end{array}$$

This form of vector is called a bi-pulse vector since it has only two non-zero pulses. This vector has the property of being spectrally flat as desired for codebook vectors. Since the +1 pulse can be in any of N possible positions and the −1 pulse can be in any one of (N−1) positions, the total number of combinations allowed is N(N−1). Since it is preferred that N equal 64, the potential size of the codebook is 4032 vectors. It is noted that use of a bi-pulse vector for the form of the codebook vector permits all the speech synthesis calculations by knowing the positioning of the +1, −1 pulses in the codevector c. Since only position information is required, no codebook need be stored. Therefore, the effect of a very large codebook can be achieved without requiring a large storage capacity.

Due to the nature of the bi-pulse vector, i.e., zeros in all positions except two which contain either +1 or −1, the computations previously required to calculate equation (10), reduce to:

$$C_i=(d_i-d_j)$$

$$G_i=(F_{ii}+F_{jj}-2F_{ij}) \tag{11}$$

where $d_i$ is the element i of the vector d, $d_j$ is the element j of the vector d and $F_{ij}$ is the element in row i and column j of the matrix F. In other words, by using a bi-pulse codeword having a single +1 and a single −1 component, the search for the optimum codeword reduces to determining position information only, which in turn reduces to manipulating the values in the d vector and the F matrix in accordance with equation (11).

The primary advantages of using this effective bi-pulse codebook are: very large effective codebook size (4032 vectors)—thus allowing good speech quality; very low storage requirement—the "codebook" itself need not be stored as the effect can be computed as in equation (11); and low computational requirement since it's very simple to compute $C_i$, $G_i$ (to find the maximum $\hat{E}$) as shown in equation (11).

During a traditional codebook search, only that part of the filtered vector Ac which falls within the current frame is optimized and the portion that carries on to the next frame is ignored. In this way, the values of $C_i$, $G_i$ are more accurate for those codebook vectors c which have pulses at the start of the frame than those that have pulses later on in the frame.

In the present invention, the problem of an ignored portion of the filtered vector is overcome by truncating impulse response $\{a_n\}$ of the LPC synthesis filter to a small number of values, i.e, use a new impulse response $\{a'_n\}$ defined as:

$$\begin{aligned} a_n' &= a_{n'} \quad n = O \text{ to } NTRUNC-1 \\ &= 0 \quad n = NTRUNC \text{ to } N-1 \end{aligned} \tag{12}$$

Figure 7:
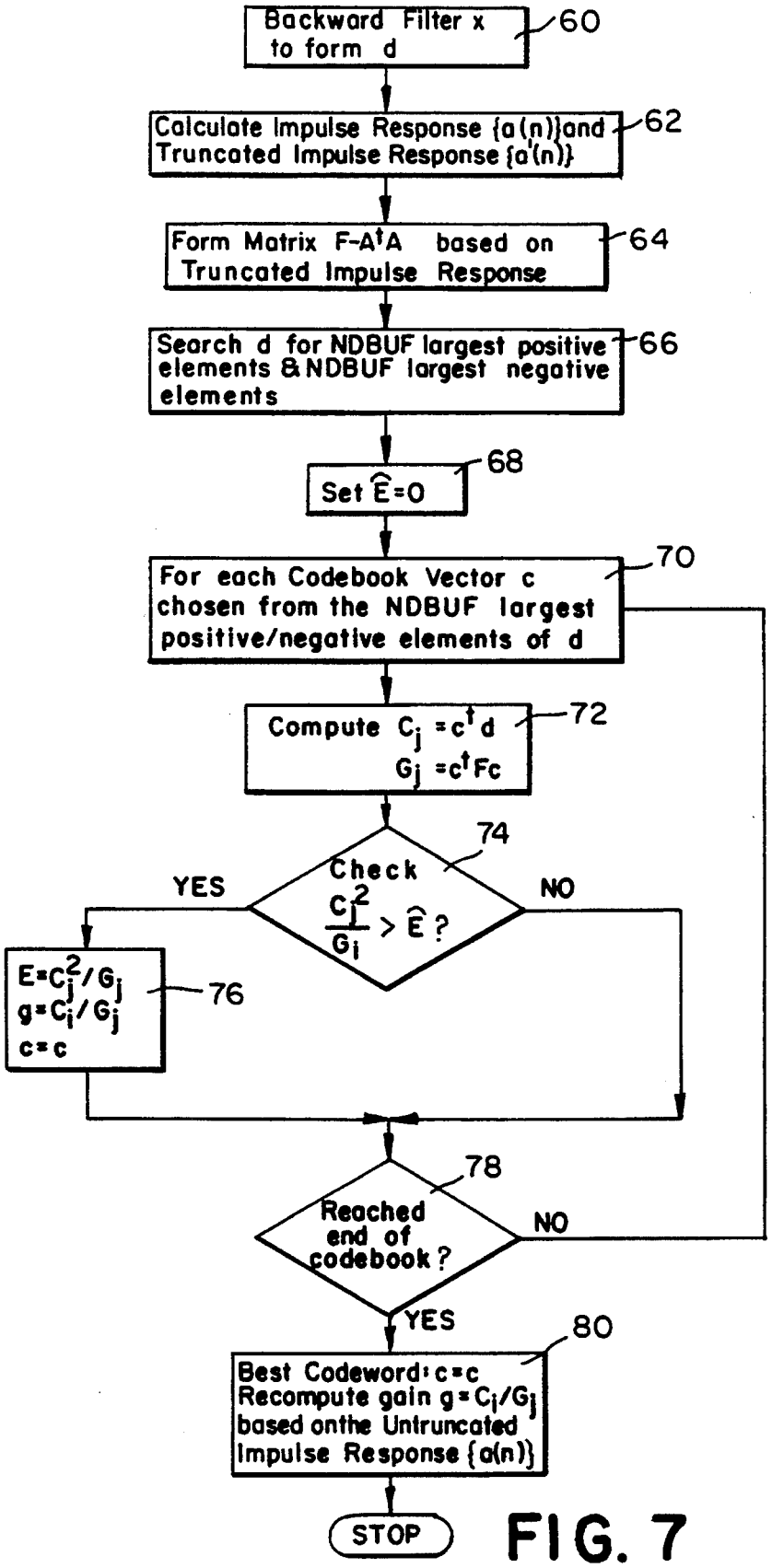
FIG. 7 is a flow chart of a codebook search technique in accordance with the present invention.
Figure 8:
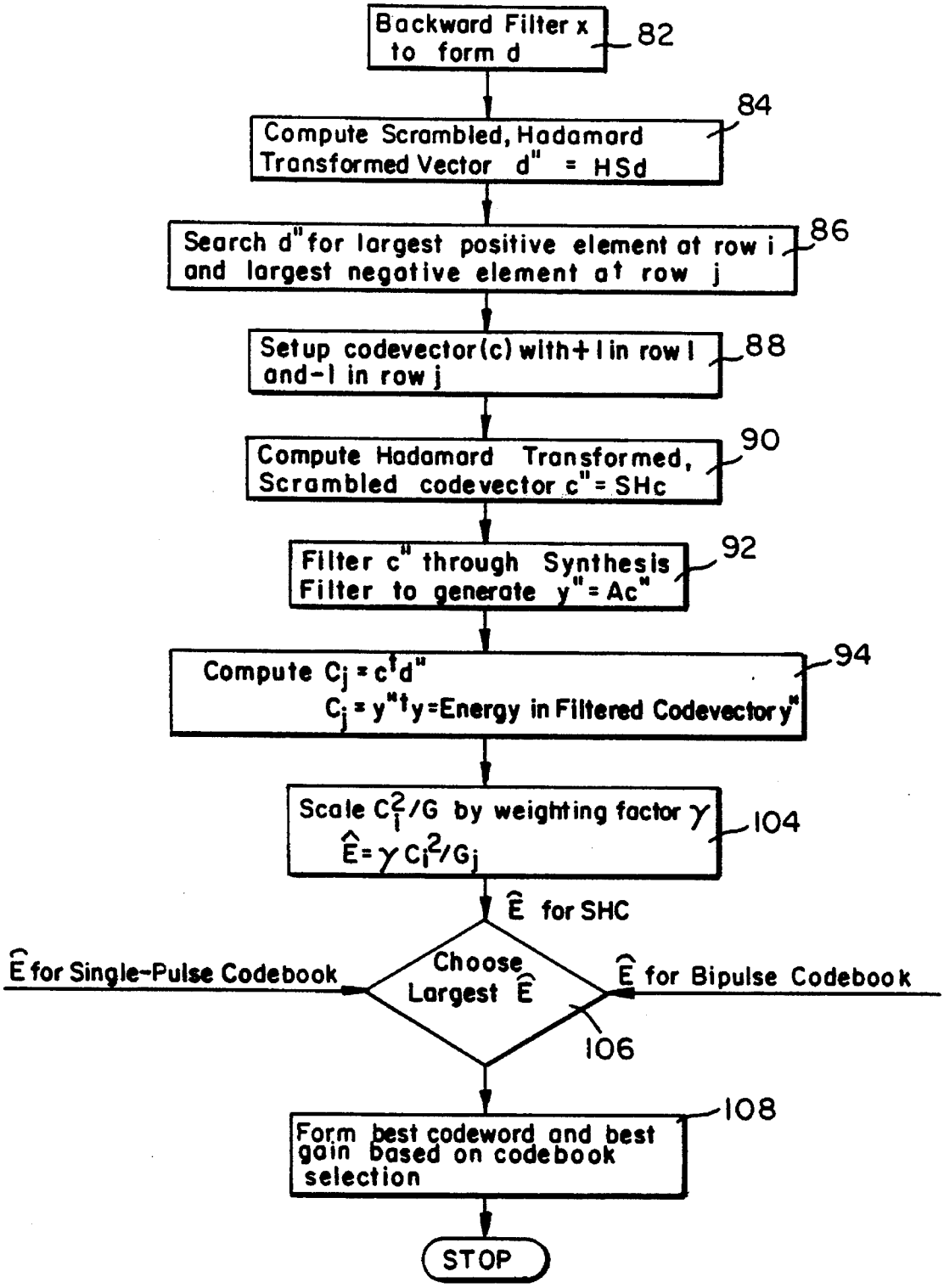
FIG. 8 is a flow chart of another codebook search technique in accordance with the present invention.

This calculation of the impulse response and its truncation are performed at 62 in FIG. 7.

As indicated previously, the impulse response of the synthesis filter contains 64 values, i.e. N=64. In the truncated modification, the original impulse response is chopped off after a certain number of samples. Therefore, the energy produced by the filtered vector Ac will now be mostly concentrated in this frame wherever the pulses happen to be. It is presently preferred for the value of NTRUNC to be 8. Precomputing the (N-by-N) matrix F (equation 9), based on the truncated impulse response, is performed at 64.

It's important to note that this truncation is only performed for the bi-pulse codebook search procedure, i.e, to compute $C_i$, $G_i$ for each codebook vector c. After the best codeword c has been found by maximizing $C_i^2/G_i$, a new set of $C_i$, $G_i$ for this particular codeword are computed based on the full impulse response $\{a_n\}$ and this full response computation is used to calculate a new gain $g=C_i/G_i$.

The full response computation is used for the gain calculation since, although the truncated impulse response evens up the chances of all pulse positions being picked for a particular frame, the values of $C_i$, $G_i$ produced by the bi-pulse process are not quite "exact" in the sense that they no longer exactly minimize the error between the gain-scaled filtered codevector gAc and the target vector x. Therefore, the untruncated response must be used to compute the value of the gain g which does actually minimize this error.

It will be recalled that $C_i^2/G_i$ and $C_i/G_i$ were also used in traditional codebook searching in order to find the best codeword and the appropriate gain. By use of the present invention, these values are calculated more quickly. However, the time necessary to calculate the best codebook vector and the efficiency of such calculations can be improved even further.

It will be recalled that in the preferred embodiment N=64. Consequently, even the simplified truncated search described above still requires the computation of $C_i$, $G_i$ for N(N−1) or 4,032 vectors and this would be prohibitive in terms of the processing power required. In the present invention only a very small subset of these possible codewords is searched. This reduced search yields almost identical performance to the full codebook search.

To understand this concept, consider the structure of $G_i$ a little more closely. If the filtered codevector Ac is represented as the vector y, i.e., $$y=Ac \tag{13}$$

then transposing both sides of this equation yields, $$y^t=c^tA^t \tag{14}$$

Equation (10) for $G_i$ then becomes:

$$G_i = y^t y = \sum_{n=0}^{N-1} y(n)^2 \tag{15}$$

where {y(n} for n=0 to N−1} is the set of samples which make up the vector y. This equation states that $G_i$ is actually the correlation of the filtered codebook vector y with itself (i.e, the total energy in this signal). If the two pulses in the codebook vector are widely spaced, the filter response to the +1 pulse will not interact with the response to the −1 pulse and thus the total energy in the filtered vector y will be very consistent and fairly independent of where these +1, −1 pulses actually are located within the frame.

This implies that $G_i$ will actually not vary too much with the pulse positions Thus maximizing $C_i^2/G_i$ during the codebook search is approximately equivalent to maximizing just $C_i$ and this simplifies the codebook search considerably. This process of just maximizing $C_i$ is called a "numerator only search" since it only involves computation of the numerator $C_i$ from the expression $C_i^2/G_i$. It was noted that the use of the truncated impulse response described above cuts short the filter response to each of the +1,−1 pulses and so there is less chance that the two responses will interact with each other. This makes the assumption, that $G_i$ is fairly independent of pulse position more valid.

By using a numerator only search, equation (11) can be modified as $C_i=(d_i-d_j)$. Therefore, to maximize the value of $C_i$, only the largest possible positive value for $d_i$ and the largest possible negative value for $d_i$ are required. Thus, the codebook search procedure just consists of scanning the d vector for its largest positive component which reveals i (the position of the +1 within the codebook vector c) and the largest negative component which reveals j (the position of the −1 within the codebook vector c).

The numerator only search is much simpler than the alternative of computing $C_i$, $G_i$ for each codevector. However, it relies on the assumption that $G_i$ remains constant for all pulses positions and this assumption is only approximately valid—especially if the +1, −1 pulses are close together. To alleviate this condition, instead of just finding the one largest positive value and one largest negative value in the backward filtered vector d, a search is made for a number (NDBUF) of the largest positive values (where NDBUF is a number greater than 1) and NDBUF largest negative values.

This plural search yields sample positions within d at which these maximum positive and the maximum negative values occur, i.e. $\{i_max_k$ for k=1 to NDBUF} and $\{j_min_1$ for 1=1 to NDBUF} respectively. The actual largest positive and largest negative values are, therefore, given by $\{d(i_max_k)$ for k=1 to NDBUF} and $\{d(j_min_1)$ for 1=1 to NDBUF}. The assumption is now made that, even allowing for the slight variation in $G_i$ with pulse position, the "best" codeword will still come from the pulse positions corresponding to these two sets $\{d(i_max_k)\}$, $\{d(j_min_1)\}$.

As shown in FIG. 7, this numerator only search to select NDBUF largest positive elements and NDBUF largest negative elements is performed at 66. The energy value Ê is set to zero at 68.

For each of the plurality of NDBUF values, $C_i$, $G_i$ can now be computed at 70, 72 from the following modification of equation (11), $$C_i=d(i_max_k)-d(j_min_1)$$

$$G_i=F(i_max_k,i_max_k)+F(j_min_1,j_min_1)-2F(i_max_k,j_min_1) \tag{16}$$

where F(i,j) is the element in row i, column j of the matrix

F. Using the $C_i$, $G_i$ equations, the maximum $C_i^2/G_i$ is determined in the loop including 70, 72, 74, 76 and 78. $C_i$, $G_i$ are computed at 72 The value of $\hat{E}$ or $C_i^2/G_i$ is compared to the recorded value of $\hat{E}$ at 74. If the new value of $\hat{E}$ exceeds the recorded value, the new values of $\hat{E}$, g and c are recorded at 76. The loop continues until all NDBUF variations of i and j are computed, which is determined at 78. The values for both $i_max_k$, $j_min_1$ are thus found for the best pulse positions for the codeword c. It is this value of i and j, i.e. the position of +1 and −1 in the codevector c, which will be transmitted.

It will be seen that the set of computations for equation (16) is performed for each possible $i_max_k$, $j_min_1$. Since there are NDBUF of each, this implies a total of $NDBUF^2$ evaluations of $C_i$, $G_i$. It has been found that a value of NDBUF=5 provides similar performance to the full search of calculating $C_i^2/G_i$ for each possible set of pulse positions.

In summary, the complexity reduction process of doing a numerator-only search has the effect of winnowing down the number of codevectors to be searched from approximately 4000 to around 25 by calculating the largest set of $C_i$ values based on the assumption that $G_i$ is approximately constant. For each of these 25, both $C_i$, $G_i$ (using the truncated impulse response) are then computed and the best codeword (position of +1 and −1) is found. For this one best codeword, the un-truncated impulse response is then used to compute the codebook gain g at 80. Both positions i and j as well as the gain g are provided for transmission.

Figure 1:
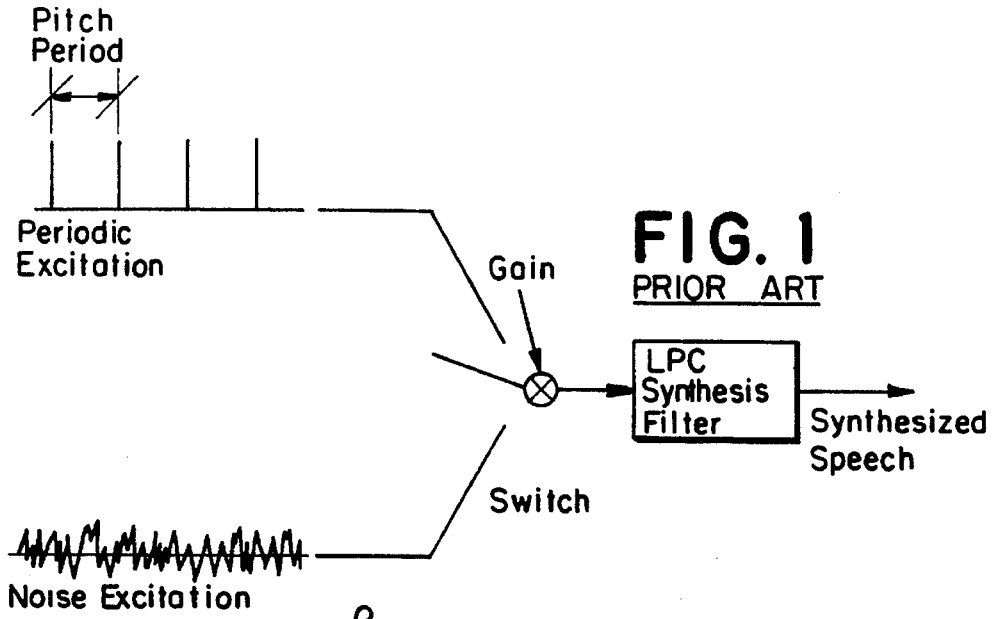
FIG. 1 PRIOR ART
FIG. 1 is a block diagram of a prior art generalized LPC vocoder.
Figure 2:
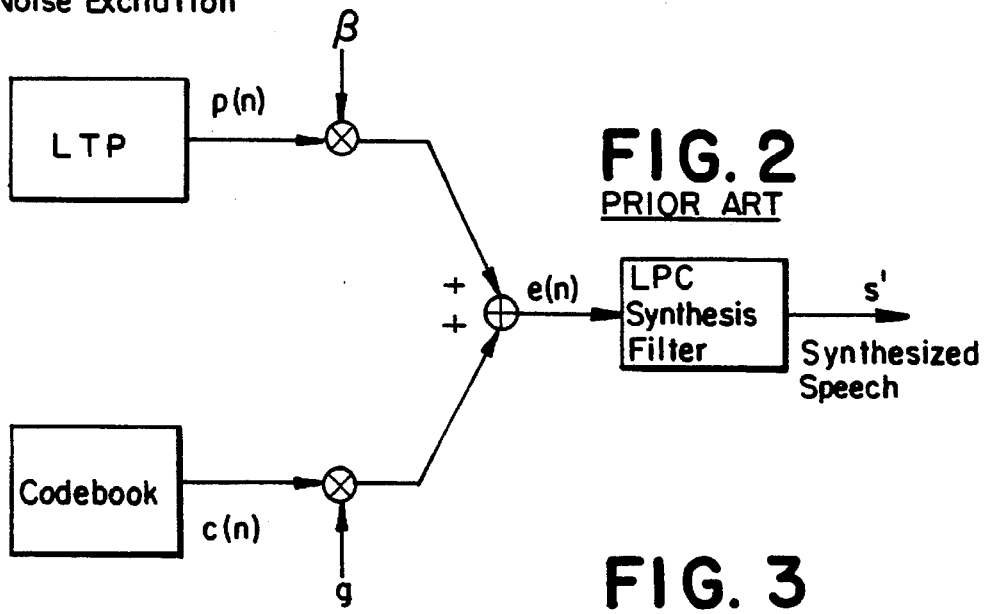
FIG. 2 PRIOR ART
FIG. 2 is a block diagram of a prior art generalized CELP vocoder-receiver.
Figure 3:
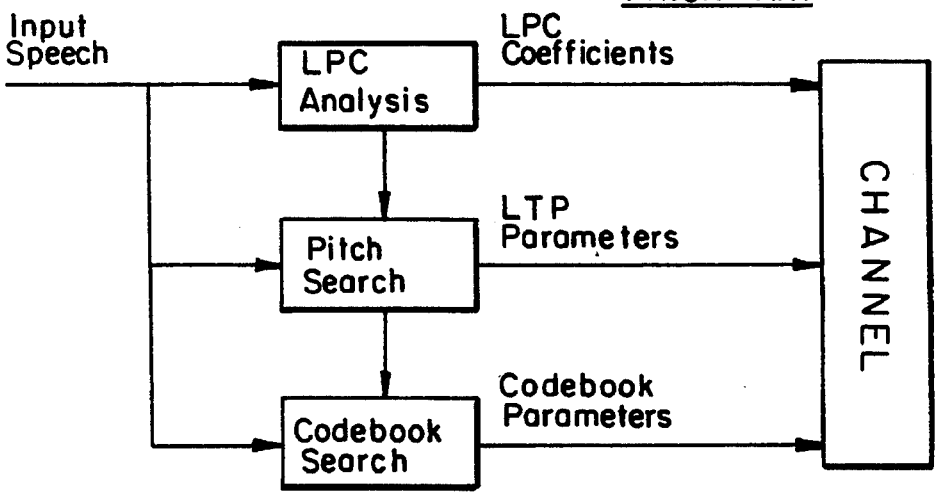
FIG. 3 PRIOR ART
FIG. 3 is a block diagram of a prior art generalized CELP vocoder-transmitter.
Figure 4:
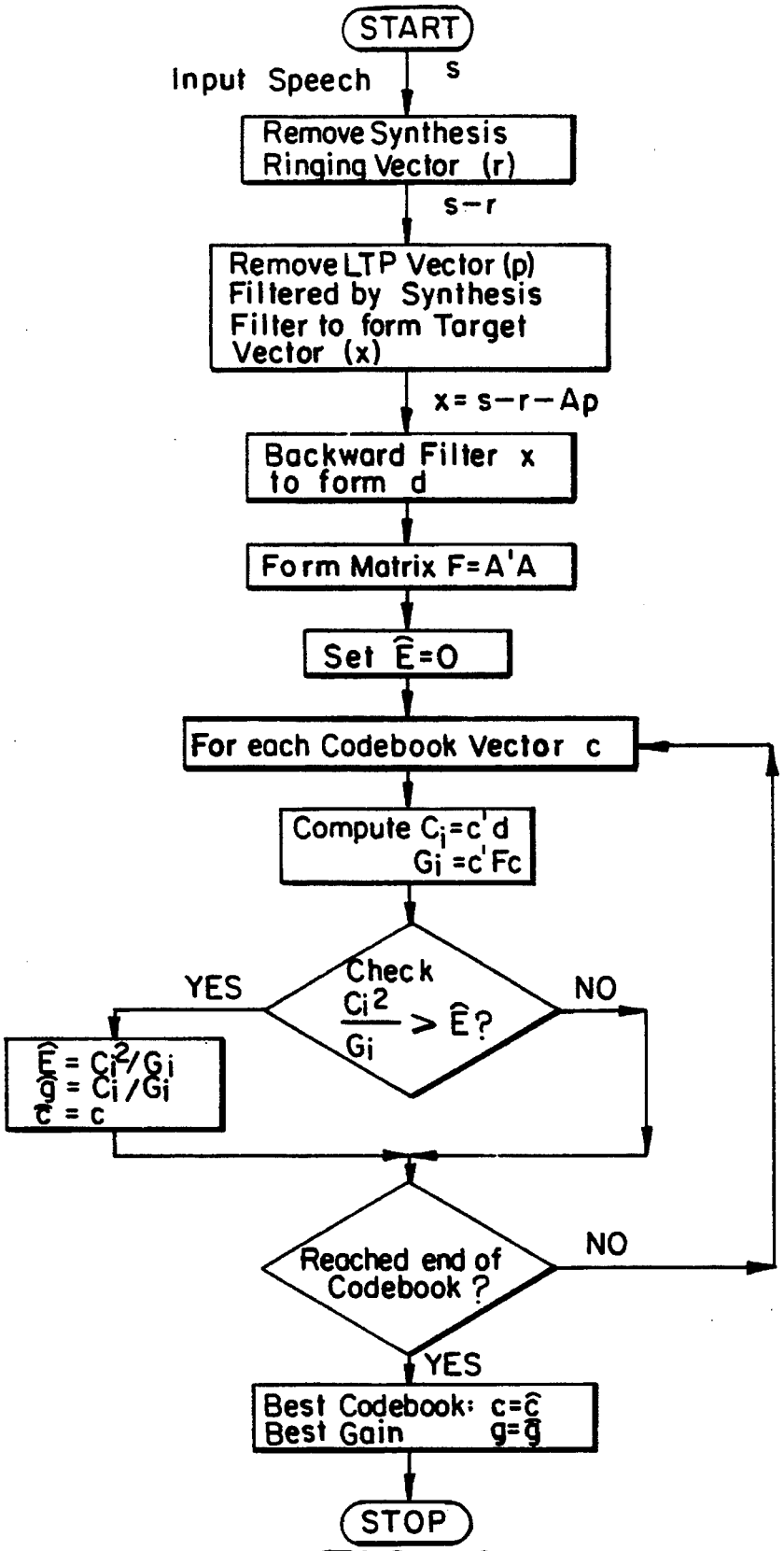
FIG. 4 PRIOR ART
FIG. 4 is a flow chart of a prior art CELP codebook search.

Consider now the scrambled codebook searching performed at 52 in FIG. 6. For voiced sounds (i.e. vowels and sounds such as z, r, l, w, n that have a definite periodicity) the excitation to the LPC synthesis filter in FIG. 2. is provided to a large extent by the LTP—i.e. in terms of FIG. 2, β is large and g is small. However, unvoiced sounds have no periodicity and so must be modeled by the codebook. Using the bi-pulse search technique at 50 for such modelling, however, is only partially successful.

Unvoiced sounds can be classified into definite types. For plosives (e.g. t, p, k), the speech waveform resembles a sharp pulse which quickly decays to almost zero. The bi-pulse codebook described above is very effective at representing these signals since it itself consists of pulses. However, the other class of unvoiced signals is the fricatives (e.g. s, sh, f) which have a speech waveform which resembles random noise. This type of signal is not well modeled by the sequence of pulses produced by the bi-pulse codebook and the effect of using bi-pulses on these signals is the introduction of a very course raspiness to the output speech.

One solution to this problem would be to use a traditional random codebook based on noise-like waveforms in parallel with the bi-pulse codebook so that the bi-pulse codebook was used when it modeled the signal best, while the random codebook was used to model the certain types of unvoiced speech for which it was most appropriate. However, the disadvantage of this approach is that, as mentioned before, the random codebook is much more difficult to search than the bi-pulse codebook.

The ideal solution would be to take the bi-pulse codebook vectors and transform them in some way such that they produced noise-like waveforms. Such an operation has the additional constraint that the transformation be easy to compute since this computation will be done many times in each frame. The transformation of the preferred embodiment is achieved using the Hadamard Transform. While the Hadamard Transform is known, its use for the purpose described below is new.

The Hadamard transform is associated with an (N-by-N) transform matrix H which operates on the codebook vector c. Hadamard transforms exist for all sizes of N which are a power of 2 so, for instance, the transform matrix associated with N=8 is as follows:

$$H=\begin{bmatrix} 1 & 1 & 1 & 1 & 1 & 1 & 1 & 1 \\ 1 & -1 & 1 & -1 & 1 & -1 & 1 & -1 \\ 1 & 1 & -1 & -1 & 1 & 1 & -1 & -1 \\ 1 & -1 & -1 & 1 & 1 & -1 & -1 & 1 \\ 1 & 1 & 1 & 1 & -1 & -1 & -1 & -1 \\ 1 & -1 & 1 & -1 & -1 & 1 & -1 & 1 \\ 1 & 1 & -1 & -1 & -1 & -1 & 1 & 1 \\ 1 & -1 & -1 & 1 & -1 & 1 & 1 & -1 \end{bmatrix} \quad (17)$$

Two general points to be noted about this transform matrix, which also apply for all values of N are:

(i) All the elements are +1, −1 with half the matrix being composed of each.

(ii) The transform matrix is symmetric, i.e, $H=H^t$.

Now, an (N-by-1) transformed codebook vector c' can now be formed that is related to the bi-pulse codebook vector c as:

$$c'=Hc \quad (18)$$

This transformed codevector can be used in equation (8) in place of c to compute $G_i$, $C_i$ and thereby find the best codevector. Since c has only two non-zero elements with the +1 at row i and the −1 at row j, the effect of forming the transform c'=Hc is such that c' is now:

$$c'=(\textit{column i of H})-(\textit{column j of H}) \quad (19)$$

The transformed codevector c' will have elements which have one of the three values 0,−2,+2. The actual proportion of these three values occurring within c' will actually be ½, ¼, ¼ respectively. This form of codevector is called a ternary codevector (since it assumes three distinct values). While ternary vectors have been used in traditional random CELP codebooks, the ternary vector processing of the invention is new.

There is, however, one problem with this new approach. From equation (17), the columns (or rows) of H exhibit sign changes from +1 to −1 and vice versa of varying frequency. The frequency by which the sign changes is formalized in the term sequency which is defined as:

$$\text{sequency}=\frac{\text{total number of sign changes in any column}}{2}$$

The transform matrix H has a very wide range of sequencies within its columns. Since c' is composed of a combination of columns of H as in equation (19), the vector c' will have similar sequency properties to H in the respect that in some speech frames there will be many changes of sign within c' while other frames will have c' vectors with relatively few changes. The actual sequency will depend on the +1,−1 pulse positions within c.

A high sequency c' vector has the frequency transform characteristic of being dominated by lots of energy at high frequencies while a low sequency c' has mainly low frequency components. The effect of this wide range of sequency is that there are very rapid changes in the frequency content of the output speech from one frame to the next. This has the effect of introducing a warbly, almost underwater effect to the synthesized speech.

It is therefore desirable to modify this approach which, while still producing noise-like codevectors such as the ternary codewords c', will yield a more consistent sequency in the codewords from one frame to the next. In the preferred embodiment, the result of more consistent sequency is achieved by introducing a "scrambling matrix" S of the form:

$$S=\begin{bmatrix} \pm1 & 0 & 0 & \cdots & 0 \\ 0 & \pm1 & 0 & \cdots & 0 \\ 0 & 0 & \pm1 & \cdots & 0 \\ \vdots & \vdots & \vdots & \ddots & \vdots \\ 0 & 0 & 0 & \cdots & \pm1 \end{bmatrix} \tag{20}$$

where the elements along the main diagonal are randomly chosen as +1 or −1. In an especially preferred embodiment, a predetermined, fixed choice of +1 and −1 is used which does not change with time or on a frame-to-frame basis. It will be recalled that in the preferred embodiment N is 64. The preferred 64 diagonal values for the scrambling matrix S are as follows: −1, −1, −1, −1, −1, −1, 1, −1, 1, 1, −1, −1, −1, 1, 1, −1, −1, 1, 1, 1, 1, 1, −1, −1, 1, 1, 1, 1, −1, 1, 1, 1, 1, 1, −1, −1, −1, 1, −1, −1, 1, −1, 1, −1, −1, −1, 1, −1, 1, 1, 1, −1, 1, −1, −1, −1, −1, 1, 1, −1, −1, 1, −1, −1.

The new transformed and scrambled codevector c" is then given by:

$$c''=SHc \tag{21}$$

The effect of the S matrix is to take each element in c'=Hc and either invert its sign or not, at random. This results in the sequency properties of c' being "broken up" so that the resulting vectors c" have almost the same sequency no matter where the pulse positions are within the bi-pulse vector c. However, c" is still composed of the values (0, +2, −2) in the same proportion as before and so the noise-like properties of the codebook are retained. The net effect of the use of this scrambling matrix is to remove the warble-like distortion and produce a more natural noise-like output for speech inputs such as the sounds s, f.

It may seem that the addition of these two matrices S, H would dramatically increase the complexity of this approach. However, although there is some increase, it is by no means undesirable.

Referring to FIG. 8, it is again noted that the target vector x, having been previously generated at 46, is again backward filtered to form vector d at 82.

The two parameters to be computed for each codeword c" are, as before, $C_i$, $G_i$ which are formed by replacing c by c" in equation (8):

$$Ci=c''^tA^tx$$

$$Gi=c''^tA^tAc'' \tag{22}$$

Now, from equation (21), $c''^t=c^tH^tS^t$, and using the property that both H, S are symmetric (i.e, $H^t=H$ and $S^t=S$), we get:

$$C_i=c^tH^tS^tA^tx=c^tHSA^tx$$

$$G_i=c^tH^tS^tA^tASHc=c^tHSA^tASHc \tag{23}$$

In describing the technique of backward filtering above, the idea was to precompute $d=A^tx$ to avoid having to form $c^tA^t$ for each codevector c. A similar idea can be used in equation (23) to precompute d" at 84 such that:

$$d''=HSA^tx \tag{24}$$

This computation is made up of three stages: (i) the calculation of $A^tx$ is just the backward filtering operation described above, (ii) the multiplication by the scrambling matrix S matrix is trivial since it just involved inverting the sign of certain entries. It will be noted that only the +1, −1 entries in S need be stored in memory rather than the whole (N-by-N) matrix), (iii) the Hadamard transform can be computed efficiently by fast algorithms.

Once d" has been computed, all that remains is to compute $C_i$ from:

$$C_i=c^td'' \tag{25}$$

where c is still the bi-pulse vector. This is exactly the same as equation (10) with d being replaced by d" and so the same principles used to simplify the search for the bi-pulse codebook are also used with this scrambled Hadamard codebook (SHC). In particular, the numerator-only search can be employed to reduce the number of codebook entries searched from N(N−1) to $NDBUF^2$. For these $NDBUF^2$ possibilities, both $C_i$, $G_i$ are then computed and the codeword which maximizes $C_i^2/G_i$ is found. We can now examine the computation of $G_i$ a little more closely. If we let y"=Ac", then equation (22) can be rewritten as:

$$G_i=y''^ty'' \tag{26}$$

which is just the correlation of this filtered signal y" with itself. However, this expression cannot be simplified much further and so this approach must be used to calculate $G_i$. Since this process is somewhat expensive computationally (although not prohibitively so), it is desirable to minimize the number of times this computation is required. Since $G_i$ is only calculated $NDBUF^2$ times, a value of NDBUF=1 is preferably chosen. This implies that only the largest positive and largest negative entries in the vector d" are searched at 86 and the positions of these extreme values give the pulse positions in the codevector c generated at 88. The scrambled codevector c" is formed at 90 and filtered through the LPC synthesis filter to form y" at 92. At 94 the value $C_i$ is formed using equation (25) and the value $G_i$ is then formed using equation (26) both with the un-truncated impulse response and the gain $g=C_i$, $G_i$ can finally be evaluated.

Consider now the single pulse codebook searching performed at 54 in FIG. 6. The single pulse codebook is made up of vectors that are zero in every sample except one which has a +1 value. This codebook is not only similar in form to the bi-pulse codebook but also in its computational details. Consequently, a flow chart similar to that shown in FIG. 7, has not been shown. If the +1 value occurs in row k of the codeword c, the values $C_i$, $G_i$ are now computed as:

$$C_i=d_k$$

$$G_i=F_{kk} \tag{27}$$

In most other respects, this codebook is identical to the bi-pulse codebook so that the concepts of a truncated impulse response for the codebook search and a numerator-only search are again utilized.

Since there are three codebook search techniques utilized, it must be decided which codebook vector to use during any particular frame. The decision, made at comparator 100 in FIG. 6, generally involves determining which codebook vector minimizes the error between the synthesized speech and the input speech signal or equivalently, which codebook vector has the largest value for $C_i^2/G_i$. This strategy works well for choosing between the bi-pulse and single-pulse codebooks. However, the SHC is so different from the other two that a slight modification is required.

The reason for the modification is that the SHC was designed to operate well for fricative unvoiced sounds (e.g. s, f, sh). The speech waveforms associated with these sounds are best described as being made up of a noise-like waveform with occasional large spikes/pulses. The bi-pulse codebook will represent these spikes very well but not the noise component, while the SHC will model the noise component but perform relatively poorly on the spikes.

Since the maximization of $C_i^2/G_i$ is associated with the minimization of a squared error between input and synthesized speech signals, an error at the spikes is weighted very heavily in the total error and so the SHC will occasionally produce large squared errors even for fricative speech inputs. However, the squared error is not necessarily the best error criterion since the ear itself is sensitive to signals on a dB (or log) scale which gives small signals a larger importance relative to larger signals than a squared error criterion would imply. This means that, even if choosing the SHC would be the best decision perceptually, the squared error criterion may not come to the same final choice.

Therefore, it is necessary to artificially weigh the decision at 102 in FIG. 6 in favor of the SHC. The way in which this is achieved, referring again to FIG. 8, is by computing $C_i^2/G_i$ for each of the codebooks and then multiplying that for the SHC by a weighting factor $\gamma$ at 104 before comparing it with the corresponding values for the other codebooks. It is preferred to use a value of $\gamma$=1.25. This value ensures that the SHC is chosen for those signals on which it performs best (e.g. unvoiced fricatives and other noisy signals) while the bi-pulse and single-pulse codebooks are used for signals such as plosives. The largest value of $\hat{E}$ is chosen at 106 and the best codeword and gain g are formed at 108 and provided for formatting at 44 (FIG. 6). Formatted information is provided to Tx buffer 110 for provision to bus 14.

Figure 9:
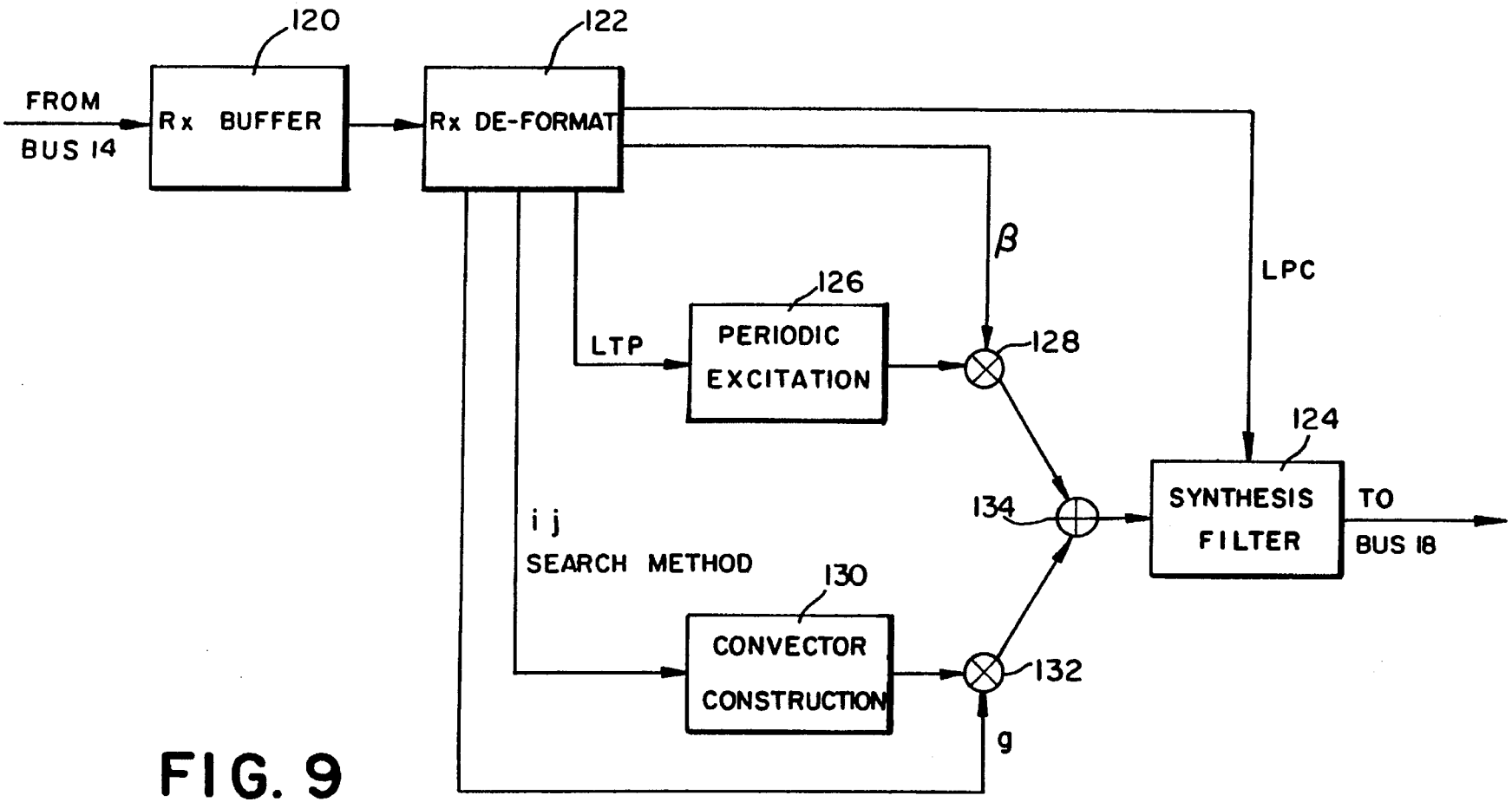
FIG. 9 is a flow chart of those operations performed in the adaptive transform coder shown in FIG. 5, subsequent to reception to perform speech synthesis.

Referring now to FIG. 9, a receiver constructed in accordance with the present invention is disclosed. It is noted that FIG. 9, similar to FIG. 6, is representative of programming used in conjunction with device 10 shown in FIG. 5. Transmitted telecommunication signals appearing on bus 18 are first buffered at 120 in order to assure that all of the bits associated with a single block are operated upon relatively simultaneously. The buffered signals are thereafter deformatted at 122. LPC information is provided to synthesis filter 124. LTP information is provided to the periodic excitation generator 126. The output of generator 126 is multiplied by the gain $\beta$ at multiplier 128. The i and j information together with the identification of the particular search method chosen at 100 in FIG. 5, are provided to codevector construction generator 130. The output of generator 130 is multiplied by the gain g at multiplier 132. The outputs of multipliers 128 and 132 are summed in summer 134. The summed signal is provided to synthesis filter 124 as the excitation signal.

It will be recalled that different a codevector c is generated for each of the codebook search techniques. Consequently the identification of the codebook search technique used allows for the proper codevector construction. For example, if the bi-pulse search was used, the codevector will be a bi-pulse having a +1 at the i row and a −1 at the j row. If the scrambled search technique is used, since the pulse positions are known the codevector c for the SHC can be readily formed. This vector is then transformed and scrambled. Thereafter it is gain-scaled at 132 and filtered at 124 to form output speech vector gASHc. If the single pulse method was used, the codevector c is still capable of quick construction.

While the invention has been described and illustrated with reference to specific embodiments, those skilled in the art will recognize that modification and variations may be made without departing from the principles of the invention as described herein above and set forth in the following claims.

What is claimed is:

1. Apparatus for determining a codeword in a speech coder which codes a speech signal, which speech coder determines a target signal formed in response to filtering said speech signal to remove ringing information and pitch information and which speech coder determines a linear prediction coefficient synthesis filter in response to said speech signal, said apparatus comprising:

impulse response means for determining the impulse response of said synthesis filter;

a first filter for filtering said target signal with said impulse response thereby forming a search signal;

position locator for locating within said search signal the position of the largest positive and largest negative values; and formation means for forming a codeword comprising a series of values, wherein all values in the codeword are zero except for a first value and a second value, wherein said first value is positioned in said codeword in response to the position of said largest positive value and said second value is positioned in response to the position of said largest negative value.

2. The apparatus of claim 1, wherein said first value is +1 and said second value is −1.

3. The apparatus of claim 1, wherein said impulse response comprises a series of impulse response values and wherein said impulse response means comprises truncation means for truncating the number of impulse response values.

4. The apparatus of claim 3, further comprising gain means for determining a gain value in conjunction with said codeword, wherein said gain means calculates said gain value in relation to the full impulse response.

5. The apparatus of claim 1, further comprising transform means for transforming said codeword, wherein said codeword is determined in relation to being transformed.

6. The apparatus of claim 5, wherein said transform is a Hadamard transform.

7. A speech coder for converting analog speech signals to digital speech signals for transmission, wherein a backward filtered target vector is provided, said speech coder comprising:

a first filter for filtering out the spectral information from said speech signal and for providing said spectral information for transmission;

a second filter for filtering out the pitch information from said speech signal and for providing said pitch information for transmission; and a codevector generator for determining the characteristics of a bi-pulse codevector representative of the speech signal after said spectral information and said pitch information have been filtered out and for providing said characteristics for transmission, wherein the determination of said characteristics is made by only analyzing the correlation between each possible bi-pulse codevector and said backward filtered target vector, wherein said codevector generator examines said correlation to determine the largest positive and largest negative values.

8. The coder of claim 7, wherein said first filter has an impulse response and wherein said codevector generator comprises a truncator for truncating said impulse response and utilizing such truncated impulse response for determining said characteristics.

9. The coder of claim 7, wherein said codevector generator determines a set of largest positive values and a set of largest negative values for said correlation.

10. A speech coder for converting analog speech signals to digital speech signals for transmission, said speech coder comprising:

a first filter for filtering out the spectral information from said speech signal and for providing said spectral information for transmission;

a second filter for filtering out the pitch information from said speech signal and for providing said pitch information for transmission; and a codevector generator for determining the characteristics of a bi-pulse codevector representative of the speech signal after said spectral information and said pitch information have been filtered out and for providing said characteristics for transmission, said codevector generator comprising frequency-domain transform means for transforming codevector possibilities from being representative of pulse-like sound to being representative of noise-like sound.

11. The coder of claim 10, wherein said transform means comprises a Hadamard transform.

12. The coder of claim 11, wherein said codevector generator further comprises a scrambler for modifying the sequency properties of transformed codevector possibilities.

13. The coder of claim 12, wherein said characteristics are capable of being determined by calculating the value of a fraction having a numerator and a denominator each being related to a number of codevector possibilities wherein said codevector generator only calculates said numerator and examines said numerators to determine which is the largest positive and largest negative.

14. A speech coder for converting analog speech signals to digital speech signals for transmission, said speech coder comprising:

a first filter for filtering out the spectral information from said speech signal and for providing said spectral information for transmission;

a second filter for filtering out the pitch information from said speech signal and for providing said pitch information for transmission;

a first codevector generator for determining first characteristics of a bi-pulse codevector representative of the speech signal after said spectral information and said pitch information have been filtered out and for providing said first characteristics for transmission;

a second codevector generator for determining second characteristics of a bi-pulse codevector representative of the speech signal after said spectral information and said pitch information have been filtered out and for providing said second characteristics for transmission, said second codevector generator comprising frequency-domain transform means for transforming codevector possibilities from being representative of pulse-like sound to being representative of noise-like sound;

a third codevector generator for determining third characteristics of a single-pulse codevector representative of the speech signal after said spectral information and said pitch information have been filtered out and for providing said third characteristics for transmission; and a comparator for evaluating the characteristics determined by said first second and third codebook generators and choosing one of said first, second or third characteristics.

15. The coder of claim 14, further comprising a weightor, for applying a weighting factor to one of said first, second and third characteristics.

16. The coder of claim 15 wherein said weighting factor is applied to said second characteristics.

* * * * *

UNITED STATES PATENT AND TRADEMARK OFFICE

CERTIFICATE OF CORRECTION

PATENT NO. : 5,457,783

DATED : October 10, 1995

INVENTOR(S) : Harprit S. Chhatwal

It is certified that error appears in the above-indentified patent and that said Letters Patent is hereby corrected as shown below:

On the title page, the illustrative figure and sheet 4 of 7, Figure 6, in blocks 50 and 54, the word "pluse" should read --pulse--.

Signed and Sealed this

Second Day of April, 1996

Bruce Lehman

*Attest:*

BRUCE LEHMAN

*Attesting Officer*

*Commissioner of Patents and Trademarks*